United States Patent [19]

Rohringer et al.

[11] 4,301,217

[45] Nov. 17, 1981

[54] METHOD OF FLAMEPROOFING WOOD WITH INORGANIC AMMONIUM SALTS AND DICYANDIAMIDE/FORMALDEHYDE REACTION PRODUCTS

[75] Inventors: Peter Rohringer, Schönenbuch; Hans Wegmüller, Riehen, both of Switzerland

[73] Assignee: Ciba-Geigy Corporation, Ardsley, N.Y.

[21] Appl. No.: 85,562

[22] Filed: Oct. 17, 1979

[30] Foreign Application Priority Data

Oct. 26, 1978 [CH] Switzerland ..... 11079/78

[51] Int. Cl.[3] ..... B05D 3/06; B05D 3/02; B05D 3/12; B05D 1/18

[52] U.S. Cl. ..... 428/528; 427/297; 427/351; 427/370; 427/393; 427/440; 528/268

[58] Field of Search ..... 427/393, 297, 351, 370, 427/440; 428/528; 528/268

[56] References Cited

U.S. PATENT DOCUMENTS

| | | | |
|---|---|---|---|
| 2,917,408 | 12/1959 | Goldstein et al. | 427/297 X |
| 2,950,268 | 8/1960 | Cofrancesco et al. | 528/268 |
| 3,372,131 | 3/1968 | Rohlfs et al. | 528/268 X |
| 4,073,617 | 2/1978 | LeBlanc et al. | 528/268 X |

FOREIGN PATENT DOCUMENTS

| | | |
|---|---|---|
| 2729276 | 12/1978 | Fed. Rep. of Germany . |
| 586095 | 3/1947 | United Kingdom . |
| 782418 | 9/1957 | United Kingdom . |
| 786736 | 11/1957 | United Kingdom . |
| 1146484 | 3/1969 | United Kingdom . |
| 1409460 | 10/1975 | United Kingdom . |

*Primary Examiner*—Michael R. Lusignan
*Attorney, Agent, or Firm*—John P. Spitals; Edward McC. Roberts

[57] ABSTRACT

A process for flameproofing wood is claimed, which comprises treating the wood with aqueous preparations which contain (a) at least one water-soluble ammonium salt of a non-volatile inorganic acid, e.g. ammonium sulfate or ammonium phosphate, (b) at least one water-soluble cationic reaction product of dicyandiamide, formaldehyde, optionally an ammonium salt and/or an alkylenepolyamine containing at most 18 carbon atoms, or the acid salt thereof.

Components (a) and (b) are applied in succession or preferably simultaneously and the wood is subsequently dried. The flameproof finish obtained is resistant to rinsing. The wood provided with the flameproof finish is used in particular as mine timber.

9 Claims, No Drawings

METHOD OF FLAMEPROOFING WOOD WITH INORGANIC AMMONIUM SALTS AND DICYANDIAMIDE/FORMALDEHYDE REACTION PRODUCTS

The present invention relates to a process for flameproofing wood, which comprises impregnating wood with aqueous preparations which contain (a) at least one water-soluble ammonium salt of a non-volatile inorganic acid and (b) at least one water-soluble cationic reaction product of ($b_1$) dicyandiamide, ($b_2$) formaldehyde or a formaldehyde donor, ($b_3$) optionally an ammonium salt, and ($b_4$) optionally an alkylenepolyamine containing at most 18 carbon atoms, or the acid salt thereof, said components (a) and (b) being applied simultaneously or in succession, and subsequently drying the wood.

Further objects of the invention comprise the aqueous composition for carrying out the process which contains both component (a) and component (b), provided both components are applied in the process of the invention simultaneously by the single-bath process, and the wood which is provided with a flameproof finish by the process of the invention and the use thereof as mine timber.

Examples of non-volatile inorganic acids from which component (a) is derived are sulfamic acid, in particular sulfuric acid and metaphosphoric acid and, most particularly, orthophosphoric acid.

Accordingly, the preferred unsubstituted ammonium salts employed as component (a) are in particular ammonium sulfates and, most particularly, ammonium phosphates. Suitable ammonium sulfates are both ammonium hydrogen sulfate and, in particular, ammonium sulfate. The ammonium phosphates are monomeric and polymeric phosphates. Examples of polymeric phosphates are, inter alia, ammonium polyphosphate and ammonium dihydrogen pyrophosphate and examples of monomeric phosphates are ammonium dihydrogen phosphate and ammonium hydrogen phosphate. The ammonium polyphosphates are always water-soluble polyphosphates, e.g. triphosphates. Preferred ammonium phosphates are ammonium dihydrogen phosphate and, in particular, ammonium hydrogen phosphate. Component (a), which is of primary interest, is ammonium sulfate, preferably ammonium dihydrogen phosphate, i.e. $NH_4H_2PO_4$, and, most preferably, ammonium hydrogen phosphate, i.e. $(NH_4)_2HPO_4$.

Component (b) is e.g. a reaction product of ($b_1$) dicyandiamide and ($b_2$) formaldehyde or a formaldehyde donor; preferably a reaction product of ($b_1$) dicyandiamide, ($b_2$) formaldehyde or a formaldehyde donor and ($b_3$) an ammonium salt; or a reaction product of ($b_1$) dicyandiamide, ($b_2$) formaldehyde or a formaldehyde donor, ($b_4$) an alkylenepolyamine containing 2 to 6 carbon atoms in the alkylene moiety, or the acid salt thereof, and ($b_3$) optionally an ammonium salt.

A suitable formaldehyde donor as component ($b_2$) for obtaining the reaction product (b) is hexamethylenediamine, trioxane, and, in particular, paraformaldehyde.

Formaldehyde itself is preferred to the formaldehyde donors.

The ammonium salts suitable for use as component ($b_3$) for obtaining reaction product (b) are identical with the salts employed as component (a), provided monomeric ammonium salts of metaphosphoric acid, especially of orthophosphoric acid, such as ammonium dihydrogen phosphate and ammonium hydrogen phosphate, are employed as preferred salts. However, the ammonium salts preferred as component ($b_3$) for obtaining reaction product (b) are different from the salts employed as component (a) and are derived e.g. from organic acids, such as acetic acid, and, in particular, from inorganic acids, such as nitric acid and hydrochloric acid.

Preferred polyamines as component ($b_4$) for obtaining reaction product (b) are alkylenediamines, alkylenetriamines or alkylenetetramines containing 2 to 6 carbon atoms in the alkylene moiety. Accordingly, suitable alkylenediamines, -triamines or -tetramines are trihexamethylenetetramine, tripentylenetetramine, tributylenetetramine, tripropylenetetramine, triethylenetetramine, in particular dihexamethylenetriamine, dipentylenetriamine, dibutylenetriamine, dipropylenetriamine, diethylenetriamine and, most particularly, hexamethylenediamine, pentylenediamine, butylenediamine, propylenediamine and ethylenediamine. Ethylenediamine is preferred. Suitable acid salts of these polyamines are in particular halides and, most particularly, the hydrochlorides.

Accordingly, preferred components (b) are e.g. reaction products of ($b_1$) dicyandiamide, ($b_2$) formaldehyde or paraformaldehyde and ($b_3$) ammonium chloride, ammonium acetate, ammonium nitrate, ammonium hydrogen phosphate or ammonium dihydrogen phosphate and/or ($b_4$) ethylenediamine or the halide thereof.

Especially preferred reaction products are those of ($b_1$) 2 moles of dicyandiamide, ($b_2$) 1 mole of paraformaldehyde and ($b_3$) 1 mole of ammonium dihydrogen phosphate or preferably 1 mole of ammonium nitrate; in particular reaction products of ($b_1$) 1 mole of dicyandiamide, ($b_2$) 1.0 to 2.2 moles of formaldehyde and ($b_3$) 0 to 0.8 mole of ammonium chloride, ($b_4$) 0.1 to 0.5 mole of ethylenediamine or ethylenediamine dihydro chloride; and, most particularly, reaction products of ($b_1$) 1 mole of dicyandiamide, ($b_2$) 2.0 to 2.3 moles of formaldehyde and ($b_3$) 1.0 to 1.3 moles of ammonium chloride.

The reaction products used as component (b) are in themselves known and are described e.g. in German Offenlegungsschrift 2 729 276 and in British patents 1 146 484 and 1 409 460.

If components (a) and (b) are applied simultaneously to wood in the single-bath process, the composition for carrying out the method of the invention will ordinarily contain 50 to 300 g/l, preferably 75 to 205 g/l and most preferably 120 to 180 g/l of component (a) as 100% salt, and 3 to 300 g/l, preferably 5 to 50 and especially 12 to 18 g/l of component (b) as 100% product, while the weight ratio of components (a) to (b) in the preparation is usually 0.95:0.05 to 0.55:0.45, preferably 0.95:0.05 to 0.75:0.25 and, most preferably, 0.95:0.05 to 0.85:0.15.

Components (a) and (b) are applied simultaneously, i.e. in the single-bath process, or in succession, i.e. in the two-bath process, for example by spraying or preferably by impregnating the wood.

In particular, the wood is impregnated by immersing it in the preparation (immersion process). This can be advantageously accomplished by agitating the wood in appropriate holding devices in the impregnating liquor and/or by circulating the liquor.

As a ruler, the wood is impregnated with the preparation at room temperature or at elevated temperature, e.g. at 50° to 150° C. At temperatures above 100° C., the wood is impregnated e.g. by the immersion process under pressure, for example up to an excess pressure of about 10 bar. However, it is also possible to impregnate the wood in closed vessels of conventional construction at about 50° to 100° C. by vacuum immersion, for example in a partial vacuum of up to −0.1 bar. In a particular embodiment of the invention, the wood can be impregnated by immersing it in the preparation while alternately applying vacuum, i.e. partial vacuum, and pressure, i.e. excess pressure, preferably at about −0.1 to 10 bar and 50° to 150° C. After it has been impregnated, the wood can also be subjected to a hot steam treatment at about 100° to 150° C., optionlly under pressure up to e.g. 10 bar.

If the wood is impregnated by immersion, then liquor ratios of 1:2 to 1:10, preferably 1:5 to 1:7, are usually employed. The impregnation time depends largely on the nature and the conditions of the impregnation. In the immersion process under normal pressure at a preferred temperature of 90° to 100° C., the impregnation time, depending on the nature, processing state, hardness and water absorptivity of the wood, is e.g. 5 to 60, preferably 15 to 30, minutes for shingles, and e.g. 0.5 to 24, preferably 1 to 6, hours for beams.

At the customary elevated temperature of about 50° to 150° C. at which the wood is impregnated, the preparations for impregnating the wood are in the form of clear aqueous solutions and penetrate as such into all pores of the wood which it is desired to flameproof.

After it has been impregnated the wood is dried, especially at about 15° to 35° C., for example by leaving it to stand in the air for 6 to 48 hours, preferably 12 to 24 hours for e.g. beams, and preferably 10 to 24 hours for e.g. shingles. However, the wood can also be dried with advantage in a recirculating air drier of conventional construction at temperatures of e.g. 15° to 150° C., preferably 80° to 120° C. It is usually not necessary to subject the flameproof finish to a themofixation after drying. If necessary, such a thermofixation is preferably carried out at 120° to 180° C. for 1 to 15 minutes.

The single-bath process is preferred to the two-bath process for economic reasons. In the less preferred two-bath process, the wood is impregnated with a preparation which contains component (a), then dried if desired, and impregnated once more with a preparation which contains component (b) and then dried. Normally the intermediate drying after the application of the preparation which contains component (a) and before the application of the preparation which contains component (b) is dispensed with, so that the impregnated wood in only dried once. For carrying out the two-bath process, the preparations contain the respective amounts of component (a) and component (b) referred to above and are also in the form of aqueous solutions in the conventionally employed temperature range of about 50° to 150° C.

The wood which is provided with a flameproof finish by the process of the present invention is in the most diverse states of processing, e.g. as shingles, planks or beams. All kinds of wood are possible, e.g. hardwoods, such as beech, oak and obeche wood, or softwood, such as spruce. In addition to its use in the furniture industry, the wood provided with a flameproof finish by the method of the invention is primarily used as building timber or mine timber. Mine timber is e.g. spruce and, in particular, eucalyptus wood.

The process of the present invention affords the following advantages:

the dicyandiamide reaction products employed as component (b) normally contain no undesirable free formaldehyde;

a thermofixation of the flameproof finish is usually omitted and drying is carried out preferably at 15° to 30° C. with a saving of the corresponding energy costs;

the process requires only small amounts of component (b) and is therefore particularly interesting from the cost angle;

the ammonium salts employed as component (a) are easily obtainable;

the impregnating liquors are normally only weakly acid to neutral with pH values not lower than about 4.0, so that damage to the wood, especially a diminishment of the good mechanical properties, such as, inter alia, the carrying force, is avoided;

after the impregnation, the components (a) and (b), which are normally dissolved at 50° to 150° C., are especially well fixed in the pores of the wood after cooling, usually in the form of an insoluble precipitate within the wood.

The most material advantage of the process of the invention, however, resides in the fact that, surprisingly, a particularly good resistance to rinsing of the resultant permanent flameproof finishes is obtained even with small amounts of component (b), as is evident from the following Examples.

EXAMPLES 1 TO 47

Shingles of obeche wood measuring 230 mm×20 mm×3 mm are impregnated by immersing them at 90° C. in solutions which contain components (a) and (b) and, if desired, agitating them. The shingles are then allowed to dry in the air at 20° C. for 12 hours, if desired thermofixed for 5 minutes at 150° C., rinsed with water at a rate of flow of 2 l/min., dried again in the air at 20° C. for 12 hours, and subsequently tested for their combustibility. The shingles are tested by the vertical method employed for determining the combustibility of textiles described in DIN 53 906. After ignition at an application time of 3 sec., the after-flame time is measured in seconds.

The after-flame times after rinsing are reported in Tables I to VI. These tables also indicate the times and liquor ratios when impregnating at 90° C., the rinsing time at 20° C., and the nature and amounts of components (a) and (b) contained in the impregnating liquors. The following products A to F are employed as component (b): cl Product A The reaction product of 1 mole of dicyandiamide, 2 moles of formaldehyde and 1 mole of ammonium chloride.

Product B

The reaction product of 1 mole of dicyandiamide, 2.3 moles of formaldehyde and 1.3 moles of ammonium chloride.

Product C

The reaction product of 1 mole of dicyandiamide, 1 mole of formaldehyde and 0.1 mole of ethylenediamine dihydrochloride.

Product D

The reaction product of 1 mole of dicyandiamide, 2.0 to 2.2 moles of formaldehyde, 0.8 mole of ammonium chloride and 0.1 mole of ethylenediamine.

Product E

The reaction product of 2 moles of dicyandiamide, 1 mole of paraformaldehyde and 1 mole of ammonium nitrate.

Product F

The reaction product of 2 moles of dicyandiamide, 1 mole of paraformaldehyde and 1 mole of ammonium dihydrogen phosphate.

Examples 1 to 47 show that the flameproof finishes obtained by the process of the invention on the wood using liquors which contain both the indicated components (a) and (b) are permanent, i.e. they are retained after a rinsing time of at least 15 minutes. On the other hand, the wood burns away completely after the indicated rinsing times if it is treated under the same conditions with liquors which contain only component (a) or component (a) and dicyandiamide instead of products A, B, C, D, E or F as component (b).

TABLE I

| | Impregnation conditions (immersion) | | | Thermo-fixation | | | Composition of the impregnating liquor (immersion solution) | | | | Flame-proof effect after rinsing |
|---|---|---|---|---|---|---|---|---|---|---|---|
| | | | | | | | component (a) 100% salt | component (b) 100% of product | | | |
| Example | Time in min. | liquor ratio | wood in motion +/− | (5 min. at 150° C.) +/− | Rinsing time (2 1/min) | pH of the liquor | ammonium hydrogen phosphate g/l | product A g/l | product B g/l | product C g/l | After-flame time in sec. |
| 1 | 30 | 1:5 | − | − | 15 | 8.0 | 150 | | 15.0 | | 0 |
| 2 | 30 | 1:5 | − | + | 15 | 8.0 | 150 | | 15.0 | | 0 |
| 3 | 30 | 1:6 | + | − | 30 | 7.9 | 75 | | | 3,8 | 9 |
| 4 | 30 | 1:6 | + | − | 60 | 8.0 | 150 | 15.0 | | | 2 |
| 5 | 30 | 1:6 | + | − | 60 | 8.0 | 150 | 22.5 | | | 2 |
| 6 | 30 | 1:6 | + | − | 60 | 8.0 | 150 | 30.0 | | | 10 |
| 7 | 30 | 1:6 | + | − | 60 | 8.0 | 150 | | 15.0 | | 5 |
| 8 | 30 | 1:6 | + | − | 60 | 8.0 | 150 | | 22.5 | | 8 |
| 9 | 30 | 1:6 | + | − | 60 | 8.0 | 150 | | 30.0 | | 5 |
| 10 | 30 | 1:6 | + | − | 60 | 8.0 | 150 | | | 22.5 | 6 |

TABLE II

| | Impregnation conditions (immersion) | | | Thermo-fixation | | | Composition of the impregnating liquor (immersion solution) | | | | | Flame-proof effect after rinsing |
|---|---|---|---|---|---|---|---|---|---|---|---|---|
| | | | | | | | component (a) 100% salt | component (b) 100% product | | | | |
| Example | time in min. | liquor ratio | wood in motion +/− | (5 min. at 150° C.) +/− | Rinsing time (2 1/min) | pH of the liquor | ammonium dihydrogen phosphate g/l | product A g/l | product B g/l | product C g/l | product D g/l | After-flame time in sec. |
| 11* | 5 | 1:7 | − | − | 15 | 3.9 | 123 | 12.3 | | | | 0 |
| 12* | 15 | 1:7 | − | − | 15 | 3.9 | 123 | 12.3 | | | | 3 |
| 13* | 5 | 1:7 | − | − | 15 | 3.9 | 123 | | 12.5 | | | 0 |
| 14* | 15 | 1:7 | − | − | 15 | 3.9 | 123 | | 12.5 | | | 4 |
| 15* | 5 | 1:7 | − | − | 15 | 3.9 | 123 | | | | 12.5 | 1 |
| 16* | 15 | 1:7 | − | − | 15 | 3.9 | 123 | | | | 12.5 | 0 |
| 17 | 30 | 1:6 | + | − | 30 | 4.0 | 75 | 7.5 | | | | 9 |
| 18 | 30 | 1:6 | + | − | 30 | 4.0 | 75 | 11.3 | | | | 10 |
| 19 | 30 | 1:6 | + | − | 30 | 4.0 | 75 | | 15.0 | | | 1 |
| 20 | 30 | 1:6 | + | − | 30 | 4.0 | 75 | | | 3,8 | | 2 |
| 21 | 30 | 1:6 | + | − | 30 | 4.0 | 75 | | | 7,5 | | 7 |
| 22 | 30 | 1:6 | + | − | 60 | 3.9 | 150 | 15.0 | | | | 4 |

*In Examples 11 to 16, the wood is not dried in the air for 12 hours after impregnation, but is dried at 100° C. for 10 minutes in a recirculating air drier.

TABLE III

| Example | Impregnation conditions (immersion) time in min. | liquor ratio | wood in motion +/− | Thermo-fixation (5 min. at 150° C.) +/− | Rinsing time (2 l/min) | pH of the liquor | Composition of the impregnating liquor (immersion solution): component (a) 100% salt ammonium sulfate g/l | component (b) 100% product: ammonium hydrogen phosphate g/l | product A g/l | product B g/l | product C g/l | Flame-proof effect after rinsing After-flame time in sec. |
|---|---|---|---|---|---|---|---|---|---|---|---|---|
| 23 | 30 | 1:7 | + | − | 15 | 4.8 | 150 | | 15.0 | | | 2 |
| 24 | 30 | 1:7 | + | − | 15 | 4,8 | 150 | | 22.5 | | | 2 |
| 25 | 30 | 1:7 | + | − | 15 | 4.8 | 150 | | | 22.5 | | 3 |
| 26 | 30 | 1:7 | + | − | 15 | 4.8 | 150 | | | | 22.5 | 3 |
| 27 | 30 | 1:7 | + | − | 15 | 4.8 | 150 | | | | 30.0 | 2 |
| 28 | 30 | 1:7 | + | − | 75 | 1.0 | | 150 | 15.0 | | | 2 |

TABLE IV

| Example | Impregnation conditions (immersion) time in min. | liquor ratio | wood in motion +/− | Thermo-fixation (5 min. at 150° C.) +/− | Rinsing time (2 l/min) | pH of the liquor | Composition of the impregnating liquor (immersion solution): component (a) 100% salt ammonium polyphosphate** g/l | component (b) 100% product: product A g/l | product B g/l | product C g/l | Flame-proof effect after rinsing After-flame time in sec. |
|---|---|---|---|---|---|---|---|---|---|---|---|
| 29 | 30 | 1:7 | + | − | 135 | 7.0 | 205 | 15.0 | | | 0 |
| 30 | 30 | 1:7 | + | − | 135 | 7.0 | 205 | 22.5 | | | 0 |
| 31 | 30 | 1:7 | + | − | 135 | 7.0 | 205 | 30.0 | | | 0 |
| 32 | 30 | 1:7 | + | − | 135 | 7.0 | 205 | | 22.5 | | 4 |
| 33 | 30 | 1:7 | + | − | 135 | 7.0 | 205 | | 30.0 | | 0 |
| 34 | 30 | 1:7 | + | − | 135 | 7.0 | 205 | | | 22.5 | 2 |
| 35 | 30 | 1:7 | + | − | 135 | 7.0 | 205 | | | 30.0 | 0 |

**Main constituent: triphosphate

TABLE V

| Example | Impregnation conditions (immersion) time in min. | liquor ratio | wood in motion +/− | Thermo-fixation (5 min. at 150° C.) +/− | Rinsing time (2 l/min) | pH of the liquor | Composition of the impregnating liquor (immersion solution): component (a) 100% salt ammonium dihydrogen pyrophosphate g/l | component (b) 100% product: product A g/l | product B g/l | product C g/l | Flame-proof effect after rinsing After-flame time in sec. |
|---|---|---|---|---|---|---|---|---|---|---|---|
| 36 | 30 | 1:7 | + | − | 135 | 7.0 | 205 | 30.0 | | | 0 |
| 37 | 30 | 1:7 | + | − | 135 | 7.0 | 205 | | 22.5 | | 0 |
| 38 | 30 | 1:7 | + | − | 135 | 7.0 | 205 | | 30.0 | | 0 |
| 39 | 30 | 1:7 | + | − | 135 | 7.0 | 205 | | | 15.0 | 0 |
| 40 | 30 | 1:7 | + | − | 135 | 7.0 | 205 | | | 22.5 | 9 |
| 41 | 30 | 1:7 | + | − | 135 | 7.0 | 205 | | | 30.0 | 0 |

TABLE VI

| Example | Impregnation conditions (immersion) time in min. | liquor ratio | wood in motion +/− | Thermo-fixation (5 min. at 150° C.) +/− | Rinsing time (2 l/min) | pH of the liquor | Composition of the impregnating liquor (immersion solution): component (a) 100% salt ammonium dihydrogen phosphate g/l | component (b) 100% product: product A g/l | product E g/l | product F g/l | Flame-proof effect after rinsing After-flame time in sec. |
|---|---|---|---|---|---|---|---|---|---|---|---|
| 42 | 30 | 1:7 | + | − | 30 | 4.0 | 150 | 22.5 | | | 0 |
| 43 | 30 | 1:7 | + | − | 30 | 4.0 | 150 | 45.0 | | | 0 |
| 44 | 30 | 1:7 | + | − | 30 | 4.1 | 150 | | 22.5 | | 1 |
| 45 | 30 | 1:7 | + | − | 30 | 4.1 | 150 | | 45.0 | | 0 |
| 46 | 30 | 1:7 | + | − | 30 | 3.9 | 150 | | | 22.5 | 9 |
| 47 | 30 | 1:7 | + | − | 30 | 3.9 | 150 | | | 45.0 | 0 |

What is claimed is:

(a) 50 to 300 g/l of a water-soluble ammonium salt of a non-volatile inorganic acid, and (b) 3 to 300 g/l of a water-soluble cationic reaction product of ($b_1$) dicyandiamine;

($b_2$) formaldehyde or formaldehyde donor; and at least one of ($b_3$) an ammonium salt, or ($b_4$) an alkylenepolyamine containing at most 18 carbon atoms, or the acid salts thereof, and subsequently drying the wood.

2. The process of claim 1 wherein component (a) is an ammonium salt of sulfamic acid, sulfuric acid, or of a phosphoric acid.

3. The process of claim 1, wherein ($b_4$) is an alkylenediamine, alkylenetriamine or alkylenetetramine containing 2 to 6 carbon atoms in the alkylene moiety, or the halide thereof.

4. The process of claim 1, wherein the weight ratio of component (a) to component (b) is 0.95:0.05 to 0.55:0.45.

5. The process of claim 1, wherein the wood is impregnated at elevated temperature with a preparation which is in the form of an aqueous solution, while alternately applying vacuum and excess pressure at a liquor ratio of 1:2 to 1:10.

6. The process of claim 1, wherein the wood is dried at 15° to 150° C.

7. The process of claim 1, wherein the wood is impregnated with a preparation which contains both components (a) and (b) and then dried.

8. The wood provided with a flameproof finish by the method of claim 1.

9. A preparation for carrying out the method of claim 7, said preparation containing (a) 50 to 300 g/l of a water-soluble ammonium salt of the non-volatile inorganic acid and (b) 3 to 300 g/l of a water-soluble cationic reaction product of ($b_1$) dicyandiamide;

($b_2$) formaldehyde or a formaldehyde donor; and at least one of ($b_3$) an ammonium salt; or ($b_4$) alkylenepolyamine containing at most 18 carbon atoms, or the acid salt thereof.

* * * * *

UNITED STATES PATENT AND TRADEMARK OFFICE

CERTIFICATE OF CORRECTION

PATENT NO. : 4,301,217

DATED : NOVEMBER 17, 1981

INVENTOR(S) : PETER ROHRINGER ET AL

It is certified that error appears in the above—identified patent and that said Letters Patent is hereby corrected as shown below:

Claim 1, Column 9, before line 1, should read:

-- 1. A process for flameproofing wood, which comprises impregnating wood with aqueous preparations containing --.

Signed and Sealed this

*Fifteenth* Day of *June 1982*

[SEAL]

*Attest:*

GERALD J. MOSSINGHOFF

*Attesting Officer*

*Commissioner of Patents and Trademarks*